US010302285B1

(12) United States Patent
Hale

(10) Patent No.: US 10,302,285 B1
(45) Date of Patent: May 28, 2019

(54) LIGHTING SYSTEM FOR INSTALLATION ON A SEPARATE POST

(71) Applicant: Roger G. Hale, Arlington, TX (US)

(72) Inventor: Roger G. Hale, Arlington, TX (US)

( * ) Notice: Subject to any disclaimer, the term of this patent is extended or adjusted under 35 U.S.C. 154(b) by 0 days.

(21) Appl. No.: 14/878,811

(22) Filed: Oct. 8, 2015

(51) Int. Cl.
*F21V 21/116* (2006.01)
*F21V 21/30* (2006.01)

(52) U.S. Cl.
CPC ..... *F21V 21/116* (2013.01); *F21V 21/30* (2013.01)

(58) Field of Classification Search
CPC ..... F21V 21/116; F21V 21/30; F21V 33/008; A63B 2207/02; A63B 63/08
USPC ..... 362/413
See application file for complete search history.

(56) References Cited

U.S. PATENT DOCUMENTS 3,965,346 A * 6/1976 Thompson, Jr. ..... F21V 21/116 362/371
3,971,560 A 7/1976 Panosh
4,236,193 A 11/1980 Brandt
4,459,649 A 7/1984 Shaneour
4,492,049 A 1/1985 Gaylor
4,633,624 A * 1/1987 Targetti ..... E04B 1/1903 403/310
4,984,787 A 1/1991 Nesbit et al.
5,124,899 A * 6/1992 Hale ..... A63B 63/083 362/253
5,171,088 A * 12/1992 Tellier ..... F16M 11/10 362/233
5,209,562 A 5/1993 Glassford
5,417,438 A 5/1995 Poff
5,436,811 A 7/1995 Necking
5,664,875 A 9/1997 Hegedus
5,667,789 A 10/1997 Nunes
5,733,210 A 3/1998 Yiu
5,791,758 A 8/1998 Horgan et al.
5,941,778 A 8/1999 Vasalech
6,168,541 B1 1/2001 Gibbs
6,416,207 B1 7/2002 Chang
6,769,795 B1 8/2004 Hale
7,244,046 B2 7/2007 Webb
(Continued)

FOREIGN PATENT DOCUMENTS

FR 2645994 A1 10/1990

OTHER PUBLICATIONS

Escalade Sports, "Owner's Manual: Fold and Roll Payback Table Tennis Table"; "Net Assembly; pp. 4", Evansville, IN.; 2002. 6 pages, retrieved from www.escaladesports.com on Dec. 29, 2015.

*Primary Examiner* — Anh T Mai
*Assistant Examiner* — Jessica M Apenteng
(74) *Attorney, Agent, or Firm* — James E. Walton

(57) ABSTRACT

A lighting system is configured to be coupled to a separate post and has a pole extending upward and then outward, the pole having multiple members configured to be assembled together at joints, and a light module is coupled to the pole. A tubular sleeve may enclose a joint for providing rigidity to the joint. The light module may be connected to the pole by a rotatable coupling. A gusset may be installed on the pole for strengthening an associated member. A bracket is configured to couple to the post and to couple to the pole with a convex pole mount that prevents sideways translation of the pole relative to the bracket while installing the pole on the post. A strut having convex flanges may extend between member joints for providing rigidity to the joints.

16 Claims, 10 Drawing Sheets

(56) References Cited

U.S. PATENT DOCUMENTS

| | | | | |
|---|---|---|---|---|
| 7,374,138 | B2 * | 5/2008 | Marshall | A47F 7/00 108/49 |
| 7,462,117 | B2 | 12/2008 | White et al. | |
| 7,666,109 | B2 | 2/2010 | White | |
| 8,297,792 | B1 * | 10/2012 | Wang | F21S 8/086 362/249.03 |
| 8,845,151 | B1 | 9/2014 | Hale | |
| 2006/0291221 | A1 * | 12/2006 | Webb | A63B 63/083 362/431 |
| 2007/0297165 | A1 | 12/2007 | Watson et al. | |
| 2008/0004139 | A1 | 1/2008 | Jang | |
| 2009/0190365 | A1 | 7/2009 | Kauffman | |
| 2010/0288897 | A1 * | 11/2010 | Chang | G09F 7/18 248/229.22 |
| 2010/0328956 | A1 * | 12/2010 | Zhang | F21S 8/08 362/294 |
| 2014/0174019 | A1 * | 6/2014 | Timko | E04C 3/30 52/651.07 |
| 2016/0108590 | A1 * | 4/2016 | Wydotis | B61L 5/1872 362/430 |

* cited by examiner

LIGHTING SYSTEM FOR INSTALLATION ON A SEPARATE POST

BACKGROUND

1. Field of the Invention

This patent application relates generally to lights and more particularly to a lighting system configured to be installed on a separate post.

2. Description of Related Art

A post located at an activity area, such as a post for supporting a basketball goal, may be permanently installed at the area or may be stabilized by a ballast container to permit mobility of the post. It can be difficult to provide sufficient light to perform activities, such as lighting a basketball goal and court, without causing interference with the vision of the users. In order to overcome these problems, lighting fixtures have been attached to posts, as disclosed in U.S. Pat. Nos. 5,124,899 and 8,845,151, both to Hale and incorporated herein by reference.

BRIEF DESCRIPTION OF THE DRAWINGS

The novel features believed characteristic of the embodiments of this patent application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
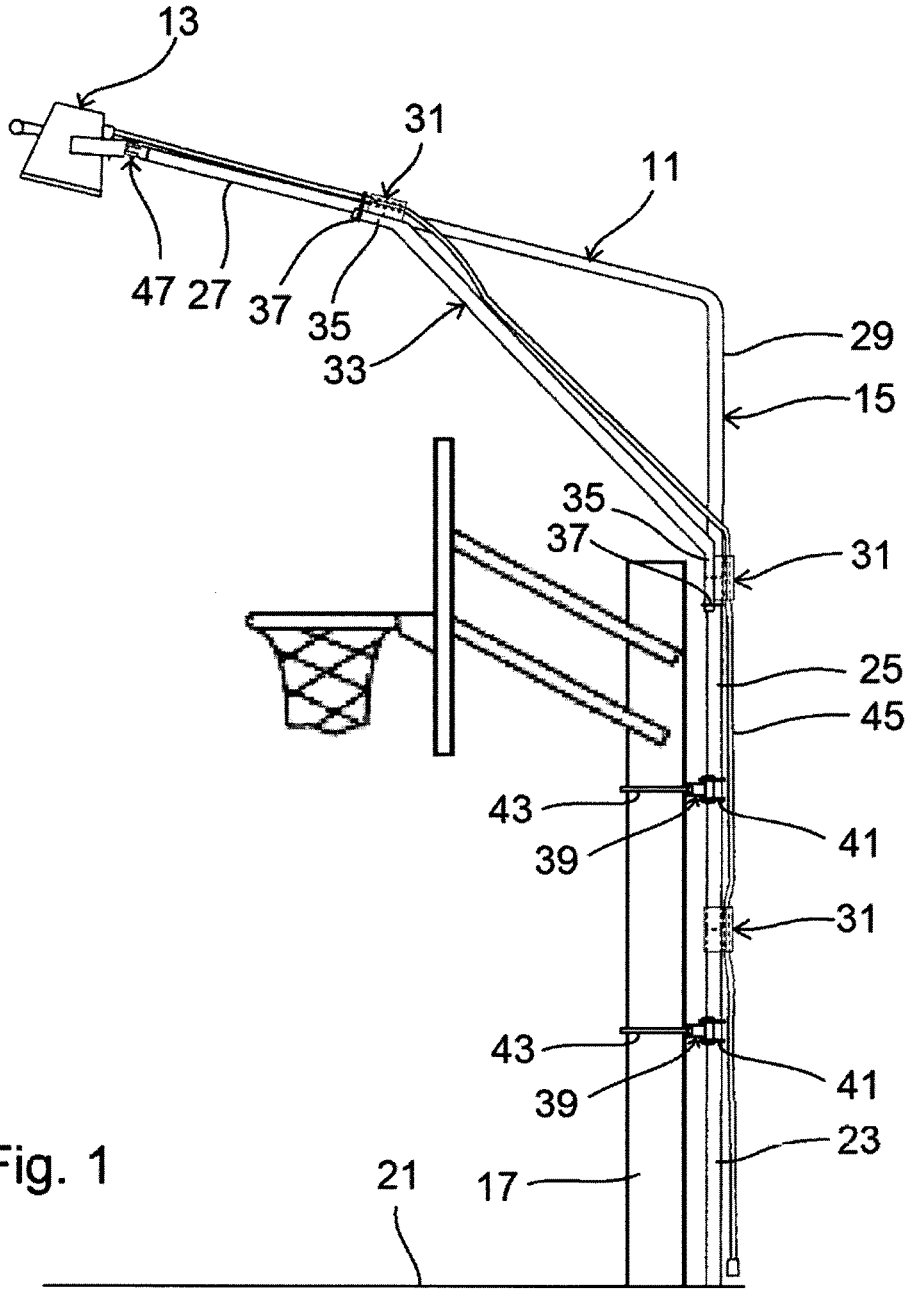
FIG. 1 is a side view of a portion of a lighting system according to this patent application, the system shown installed on a post.

Where used in the various figures of the drawings, the same reference numerals designate the same or similar parts. Furthermore, when the terms "front," "back," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing embodiments of this disclosure.

All figures are drawn for ease of explanation of the basic teachings of this disclosure only; the extensions of the figures with respect to number, position, relationship, and dimensions of the parts will either be explained or will be within the skill of persons of ordinary skill in the art after the following teachings of this disclosure have been read and understood. Further, the exact dimensions and dimensional proportions to conform to specific width, length, and similar requirements will likewise be within the skill of the art after the following teachings of this patent application have been read and understood.

DETAILED DESCRIPTION OF THE PREFERRED EMBODIMENT

Illustrative embodiments are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates an embodiment of a lighting system 11 according to this patent application, system 11 comprising a light module 13 and pole 15. System 11 is configured to be coupled to a post 17 for providing light for activities in an activity area, such as for a basketball court or a playground. Post 17 may be, for example, used to support a basketball goal 19 like that shown in FIG. 1, or post 17 may be another type, such as a utility pole located near the activity area.

In order to cast light emitted by light module 13 from above users and onto goal 19 and surface 21 of the activity area, pole 15 extends upward and outward from post 17. This positions light module 13 on the opposite side of goal 19 from post 17 and directly above a portion of surface 21, thereby lighting the front of goal 19. Post 15 comprises an assembly of members 23, 25, 27, 29, members 23, 25, and 27 being generally straight, whereas member 29 has portions that form an angle. Members 23, 25, 27, 29 are preferably formed from tubular metal, though members 23, 25, 27, 29 may be formed from any type of material with sufficient strength to withstand expected forces, such as those caused by the weight of light module 13 and by wind or impact. One end of each member 23, 25, 29 is swaged to permit the swaged end of one member 23, 25, 29 to be inserted into the non-swaged end of another member 23, 25, 27, 29, and member-to-member joints can be made more rigid with a sleeve 31.

A strut 33 comprises convex flanges 35 at each end, and strut extends from the joint formed by members 27 and 29 to the joint formed by members 29 and 25. Strut 33 may be used in addition to sleeves 31 at these joints, as shown, or strut 35 alone may be used to stiffen the joints. In either case, each flange 35 is retained tightly adjacent against pole 15 and/or the associated sleeve 31 by a retainer, such as U-bolt clamps 37.

Pole 15 is coupled to post 17 with a mounting bracket 39. Retainers, such as U-bolt clamps 41, 43, couple one portion of bracket 39 to pole 15 and couple another portion of bracket 39 to post 17. A power cable 45 preferably extends from light module 13 and down along pole 15. Though shown as external to pole 15, power cable 45 may alternatively run within an interior of one or more portions of pole 15 formed from tubular members 23, 25, 27, 29. Light module 13 is coupled to member 27 with an adjustable mount 47.

Figure 2:
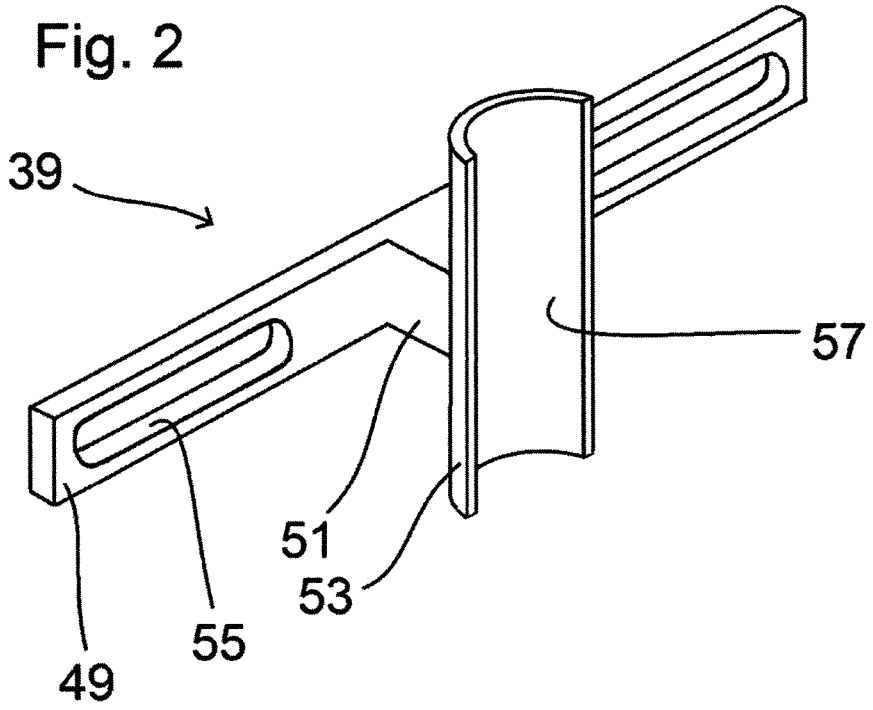
FIG. 2 is an oblique view of a mounting bracket of the system of FIG. 1.
Figure 3:
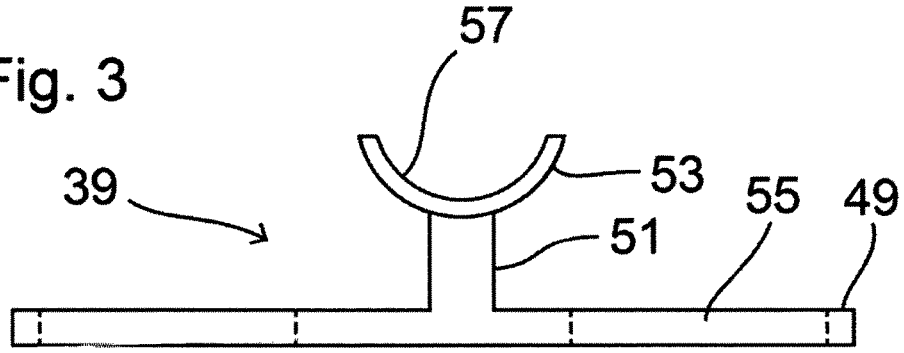
FIG. 3 is a top view of the bracket of FIG. 2.

Referring to FIGS. 2 and 3, bracket 39 comprises flat plate 49, standoff 51, and pole mount 53. Flat plate 49 has a slot 55 located on each end portion of plate 49, which has a width sufficient to allow a retainer, such as U-bolt 43, to encircle post 17 and be secured to plate 49. Mount 53 is a convex, vertically elongated member that is sized and shaped for receiving one of members 23, 25 adjacent inner surface 57. Standoff 51 spaces pole mount 53 from plate 49.

Figure 4:
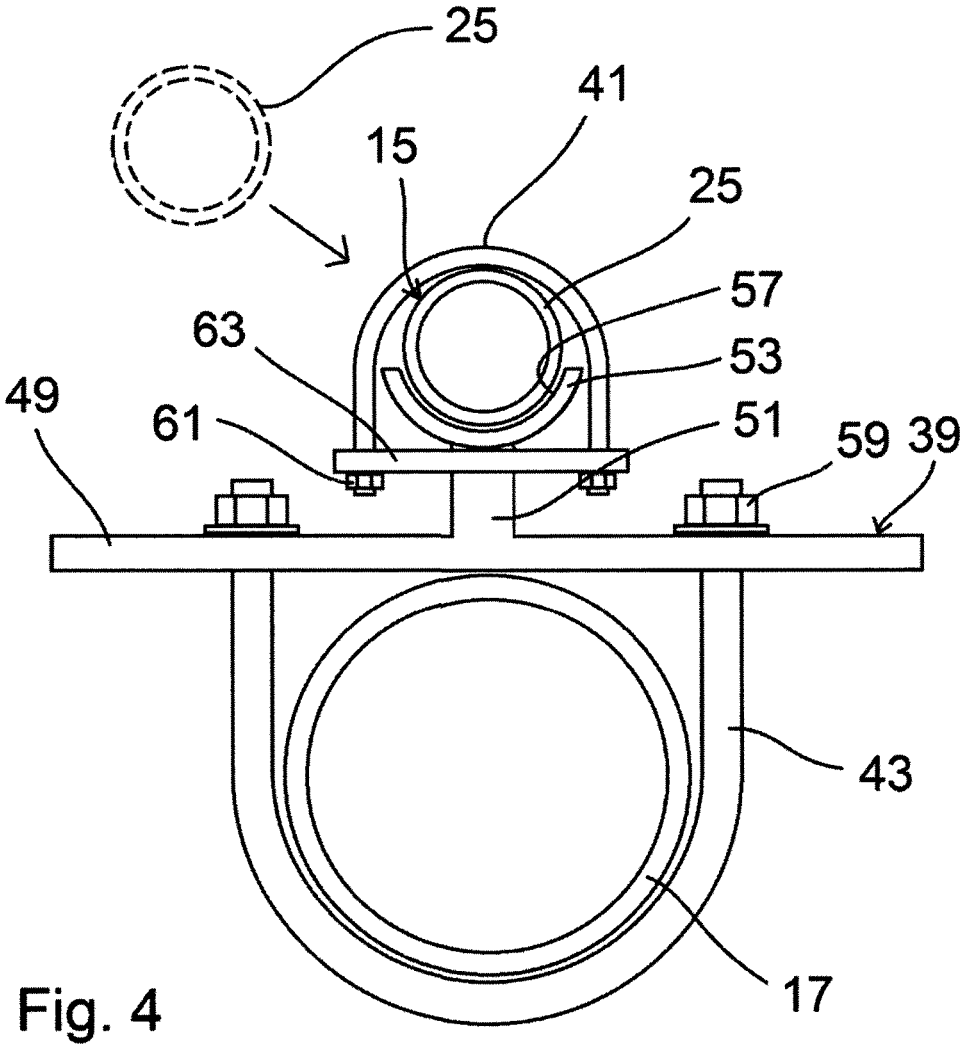
FIG. 4 is a top view of a typical installation of the bracket of FIG. 2.

FIG. 4 illustrates bracket 39 coupling pole 15 to post 17. Bracket 39 is mounted to post 17 with U-bolt 43, which extends around post 17 and through slots 55, with nuts 59 clamping plate 49 to post 17. Likewise, U-bolts 41 (only one visible), located above and below standoff 51, extend around a portion of pole 15, such as member 25. Nuts 61 cooperate with a plate 63 on the opposite side of pole mount 53 to clamp member 25 to pole mount 53, with member 25 adjacent inner surface 57 of mount 53.

The advantage to the convex shape of mount 53 is that bracket 39, once attached to post 17, allows for pole 15 to be located horizontally while installing U-bolts 41. This is an advantage over a flat pole mount, in that a user may stand pole 15 against bracket 39 during installation, and pole mount 53 tends to prevent pole 15 from sliding sideways relative to bracket 39. As shown in FIG. 4, during installation member 25 is moved toward and then into pole mount 53, which provides a vertical cradle for member 25. This cradling of member 25 assists the user in installing pole 15 to post 17, and bracket 39 can be used with pole 15 or with a hinged or rotating pole, like those shown in U.S. Pat. No. 8,845,151 to Hale.

Figure 5:
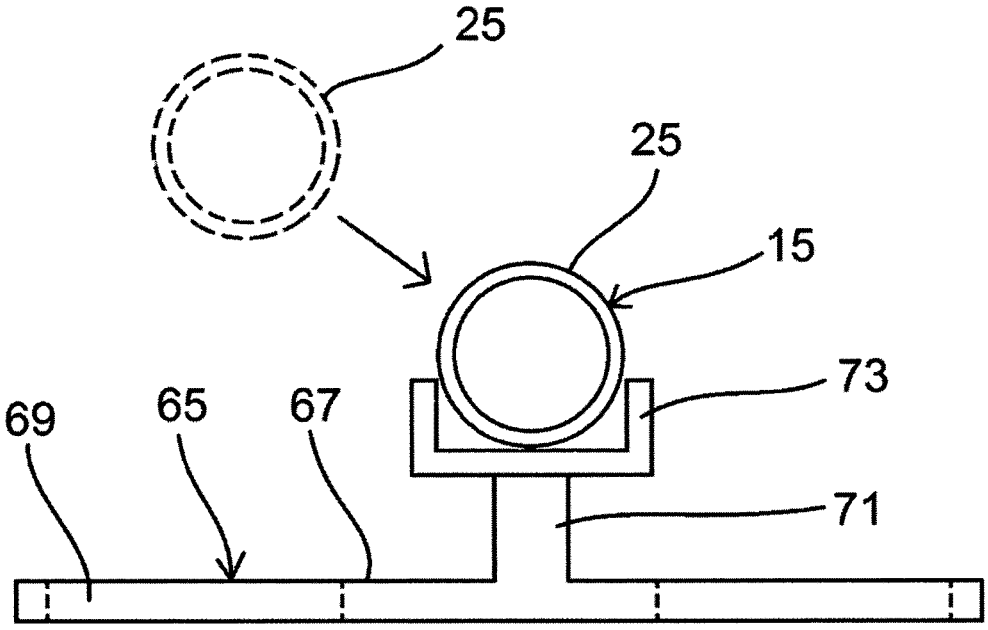
FIG. 5 is a top view of an alternative embodiment of the mounting bracket of FIG. 2.

FIG. 5 shows an alternative embodiment of a mounting bracket according to this patent application. Bracket 65 is constructed similarly to bracket 39, with a flat plate 67 having slots 69, a standoff 71, and a pole mount 73. Although, bracket 39 is shown with a rounded pole mount 53, bracket 65 has a rectangular pole mount 73. Bracket 65 is installed on post 17 in the same manner as that described above for bracket 39, with a portion of pole 15, such as member 25, then being moved toward pole mount 73 for being cradled therein while the user installs upper and lower retainers, such as U-bolts 41, to couple member 25 to pole mount 73. While only two embodiments of pole mounts 53, 73 are shown, it should be noted that other shapes of mounts, such as a V-shaped mount, will also achieve the advantages described. Also, it should be noted that other types of retainers may be used to attach pole mounts 53, 73 to member 25, and these may include flat or convex covers hinged to a pole mount 53, 73 or other two-piece designs for pole mounts 53, 73.

Figure 6:
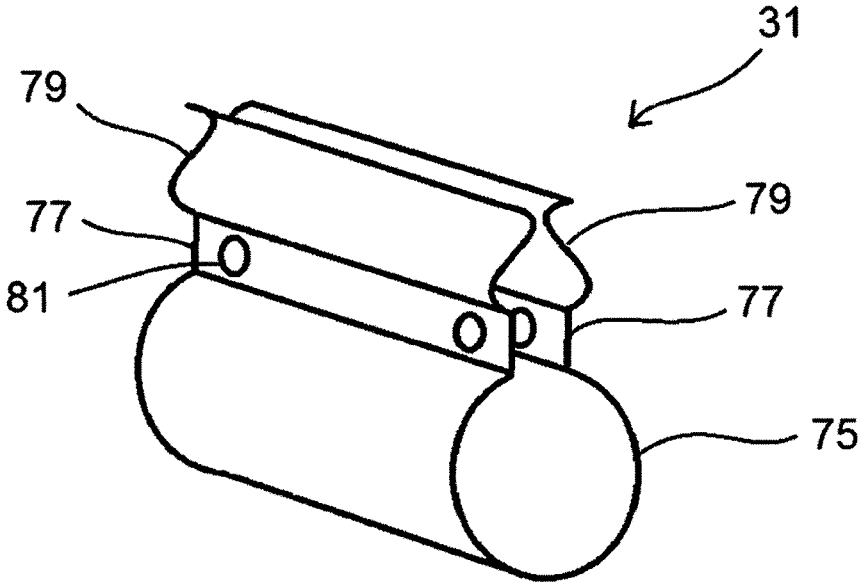
FIG. 6 is an oblique view of a coupling sleeve of the system of FIG. 1.
Figure 7:
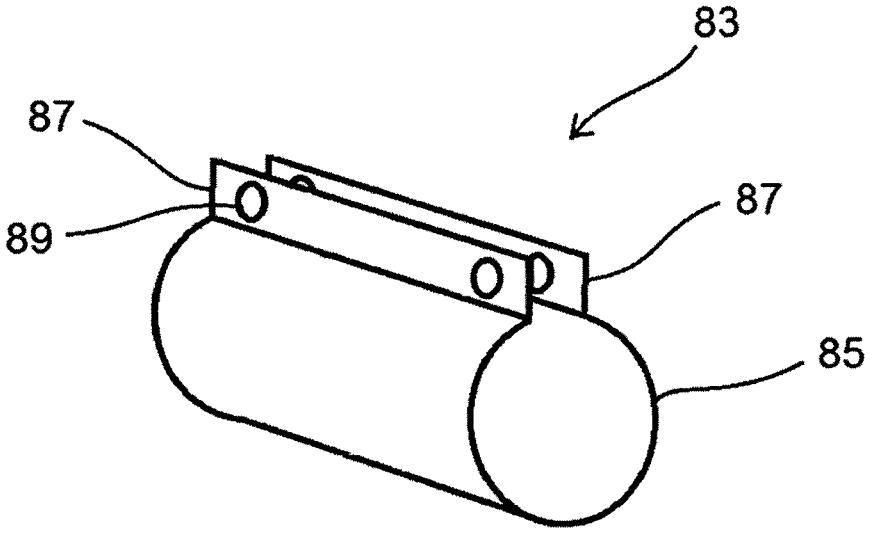
FIG. 7 is an oblique view of an alternative embodiment of the coupling sleeve of FIG. 6.

FIGS. 6 and 7 illustrate embodiments of a stiffening sleeve according to this patent application. As mentioned above, sleeves 31 can be used at joints between members 23, 25, 27, 29 of pole 15 for stiffening the joints. FIG. 6 shows sleeve 31, comprising collar 75, clamping flats 77, and cable retainers 79. Collar 75 is an incomplete circular tube sized to receive members 23, 25, 27, 29, and flats 77 extend outward from the longitudinal edges of collar 75 and generally parallel to each other. Cable retainers 79 are shaped to cooperate with each other to form a longitudinal channel for housing a cable external to pole 15, such as cable 45 of system 11. Flats 77 have apertures 81 that allow fasteners to tighten collar 75 around members 23, 25, 27, 29 when flats 77 are forced toward each other.

FIG. 7 shows sleeve 83, which is an alternative embodiment of a stiffening sleeve. Sleeves 83 comprise collar 85 and flats 87 having apertures 89, and sleeves 83 are installed and used in the same manner as sleeves 31 to stiffen joints between members 23, 25, 27, 29. Sleeves 85 lack cable retainers 79 and are preferably used when there is no need to retain an external cable, such as when a cable is carried internal to pole 15.

Figure 8:
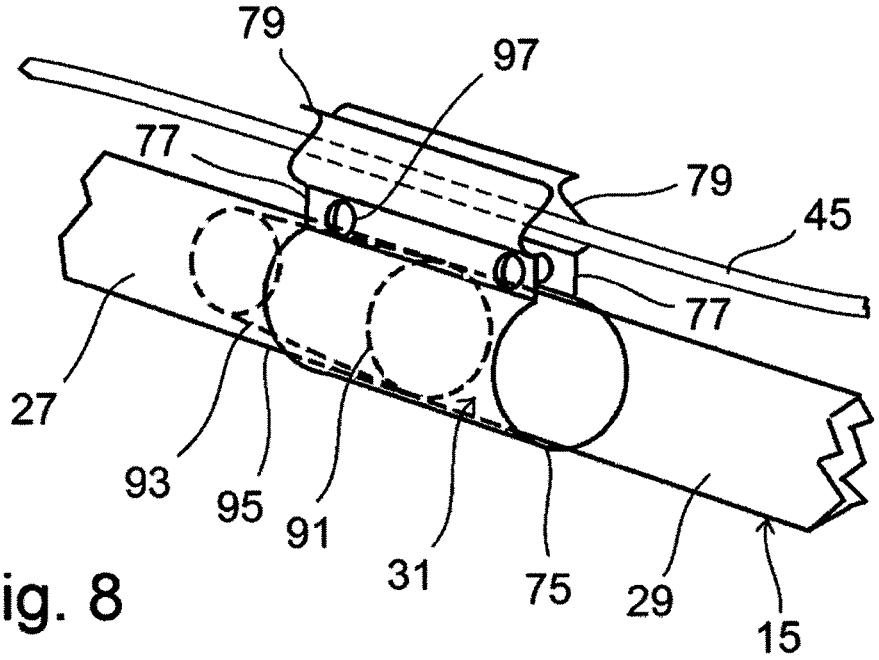
FIG. 8 is an oblique view of a portion of the system of FIG. 1.
Figure 9:
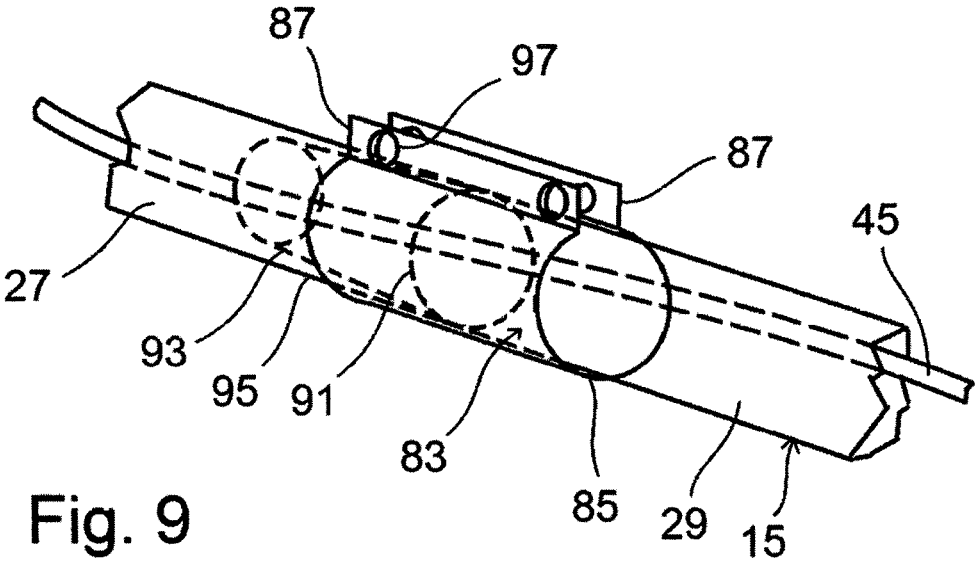
FIG. 9 is an oblique view of a portion of the system of FIG. 1 using the coupling sleeve of FIG. 7.

FIGS. 8 and 9 show sleeves 31 and 85, respectively, installed for stiffening a joint 91 formed by assembled ends of members 27 and 29. In both figures, a swaged or narrowed end 93 of member 29 is inserted into full-width end 95 of member 27. In FIG. 8, sleeve 31 is approximately centered along its length on joint 91, and collar 75 is tightened onto approximately equal portions of members 27, 29 by fasteners 97 forcing flats 77 toward each other. Cable 45, which is shown external to members 27, 29, is routed between cable retainers 79. Likewise, in FIG. 9, sleeve 83 is approximately centered along its length on joint 91, and collar 85 is tightened onto approximately equal portions of members 27, 29 by fasteners 97 forcing flats 87 toward each other. Cable 45 is shown routed internal to members 27, 29. Both sleeves 31, 83 stiffen joint 91 by adding extended support at and on Other side of joint 91, resisting bending and twisting forces. In this way, sleeves 31, 83 strengthen and stiffen joints between members 23, 25, 27, 29, providing for a stronger pole 15 that resists these forces.

Figure 10:
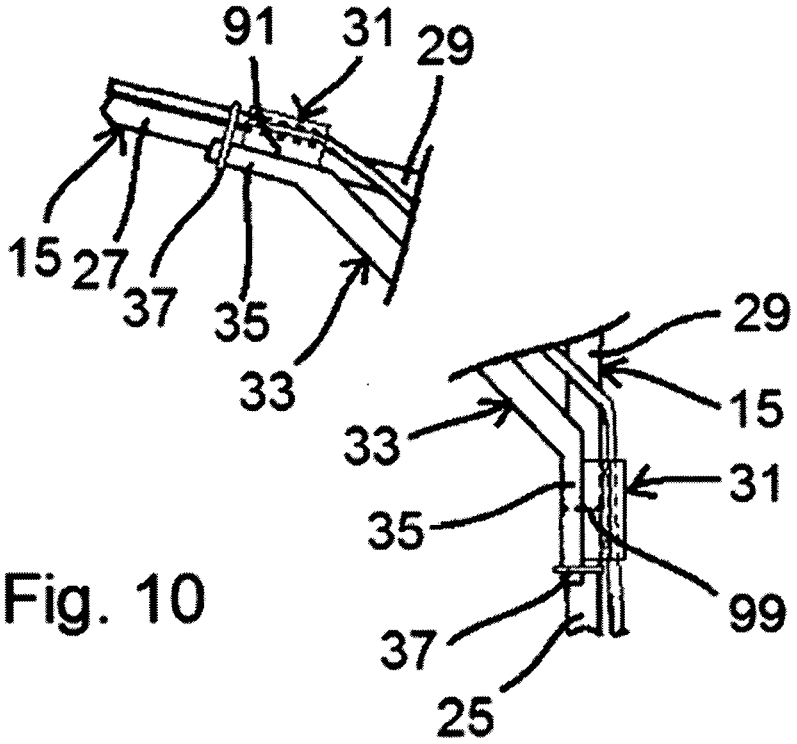
FIG. 10 is an enlarged side view of portions of the system of FIG. 1.
Figure 11:
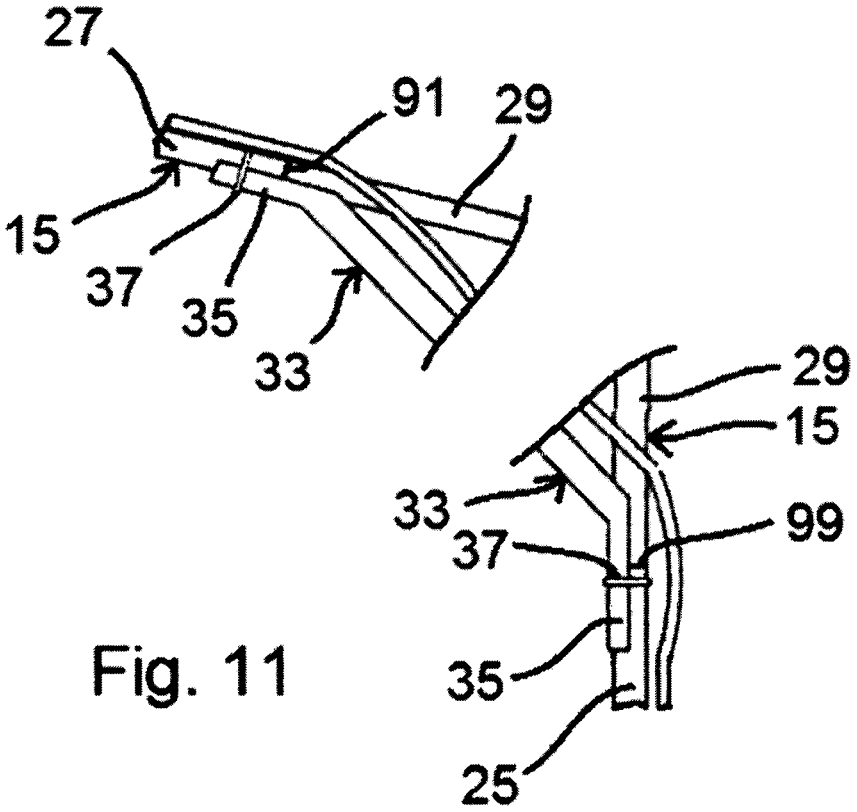
FIG. 11 is an enlarged side view of portions of alternative installation of the system of FIG. 1.

FIGS. 10 and 11 show options for installation of strut 33 on pole 15. In these figures, portions of pole 15 are shown where members 27 and 29 are assembled to form joint 91, as described above, and members 29 and 25 are assembled to form joint 99. In FIG. 10, sleeves 31 are installed on joints 91, 99, and then strut 33 is installed over sleeves 31, with flanges 35 attached to pole 15 with clamps 37, In FIG. 11, strut 33 is installed on pole 15 in the same manner, though sleeves 31 are not used at joints 91, 99. In both configurations, flanges 35 of strut 33 are preferably generally centered over joints 91, 99, and flanges 35 are drawn tightly to pole 15 with clamps 37. The arcuate, convex shape of flanges 35 partially encircles the associated members 25, 27, 29 for approximately the same distance on either side of joints 91, 99, providing extended support at and on either side of joints 91, 99 for resisting bending and twisting forces. In this way, flanges 35 of strut 33 strengthen and stiffen joints 91, 99, providing for a stronger pole 15 that resists these forces.

Figure 12:
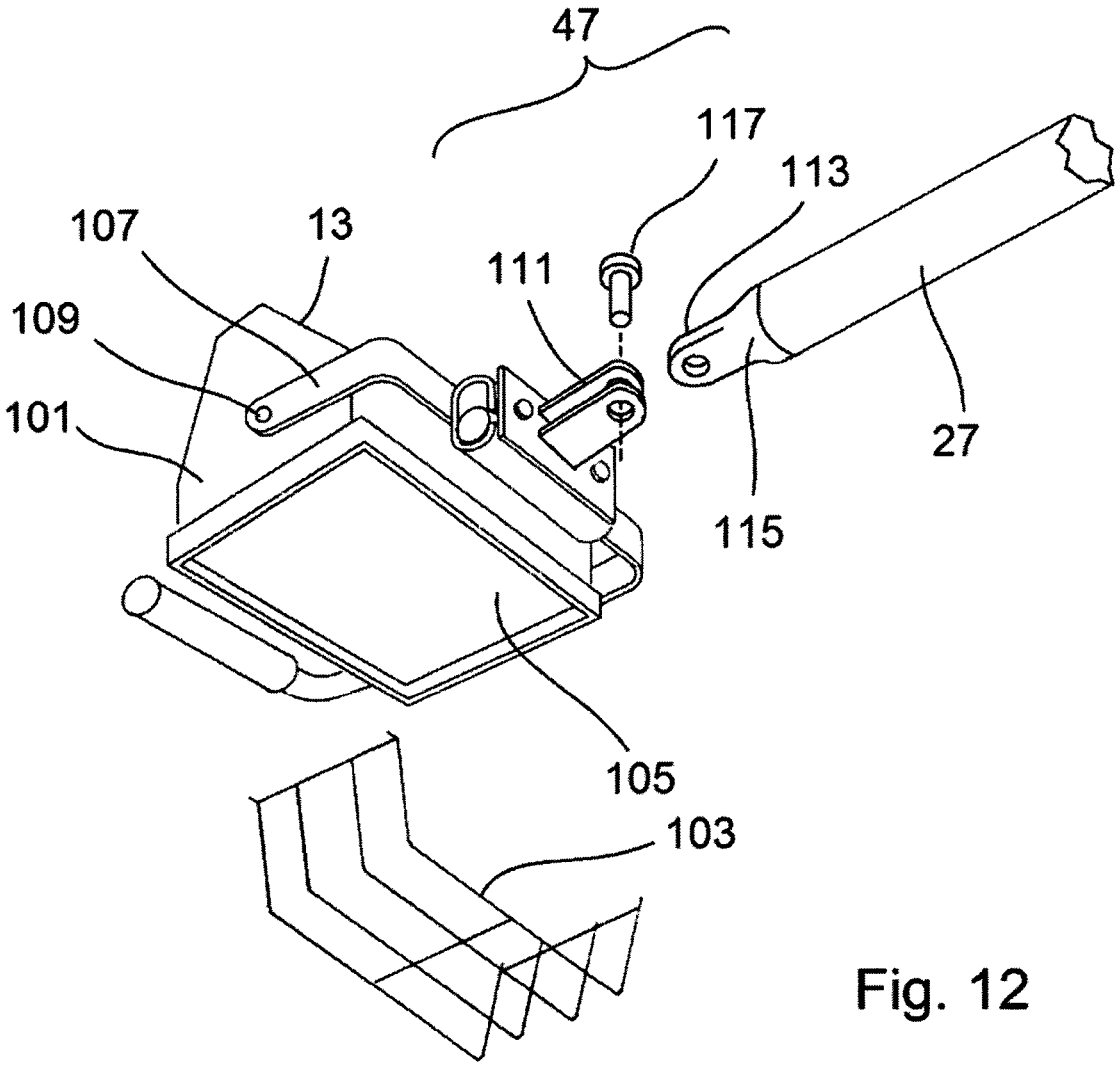
FIG. 12 is an oblique exploded view of a light module and adjustable coupling of the system of FIG. 1.

FIG. 12 illustrates light module 13 and adjustable light mount 47 for coupling module 13 to member 27 of pole 15. Light module 13 comprises a light emitting source, such as halogen light assembly 101, which includes guard 103 for protecting lens 105. A bracket 107 allows assembly 103 to rotate about a generally horizontal axis on fasteners 109. In the preferred embodiment, bracket 107 has a clevis 111 configured to receive a tang 113 of a mount 115 installed at the outer end of member 27. A bolt or other shaft couples clevis 111 and tang 113 together, forming a hinge in light mount 47. Though shown as a tang-and-clevis type coupling, other types of couplings may be used that allow for light assembly 103 to pivot relative to pole 15. It should be noted that more than one light module 13 may be installed on pole 15 using alternative embodiments of light mount 47 or through alternative embodiments of pole 15.

Figure 13:
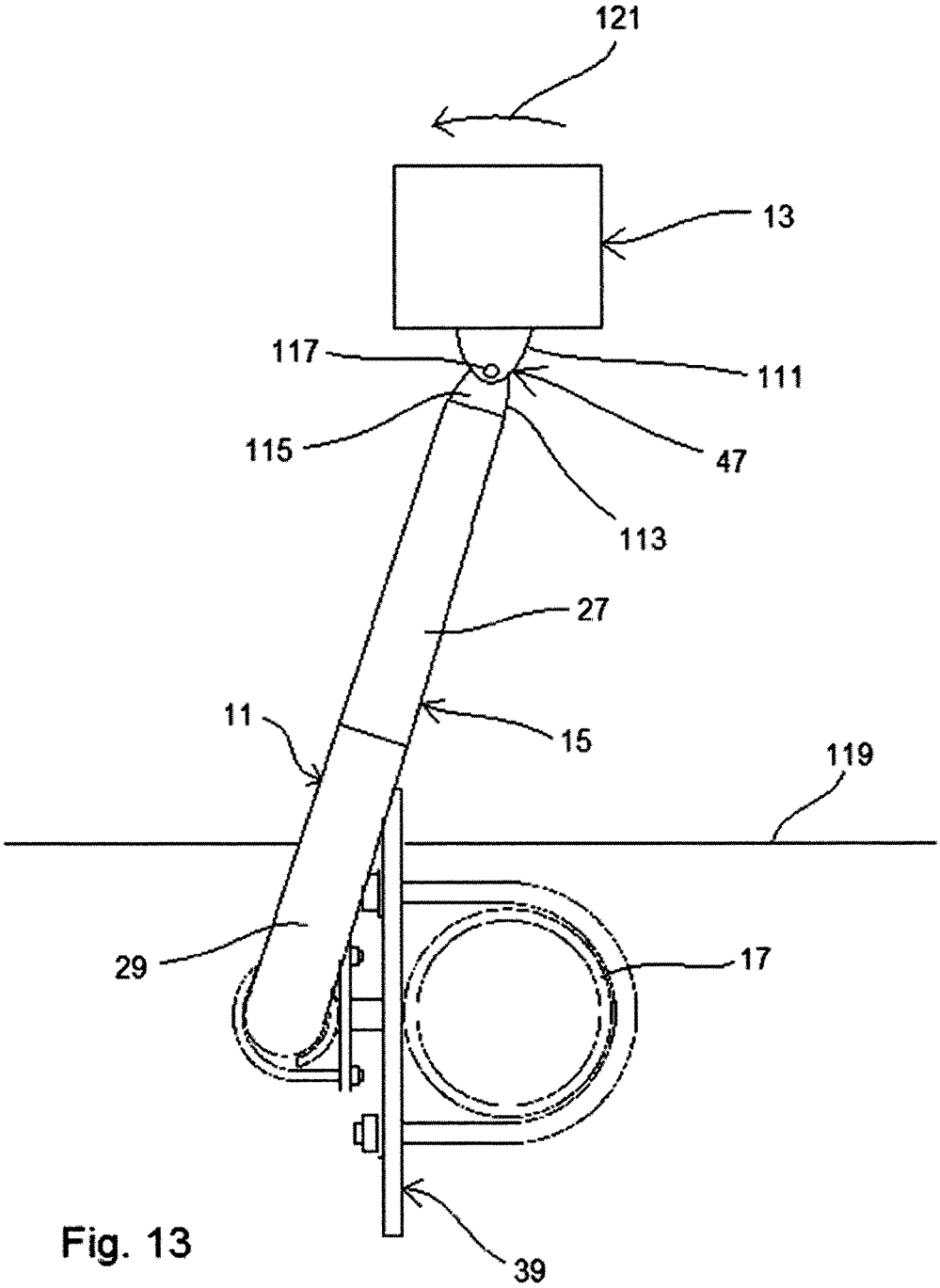
FIG. 13 is a top view of an alternative installation of the system of FIG. 1.

FIG. 13 illustrates the advantage to using light mount 47, which is the ability to rotate light module 13 about a generally vertical axis relative to pole 15. This is especially useful when pole 15 extends outward at an angle relative to an edge 119 of an activity area, such as when pole 15 is attached to the side of post 17, as shown in the figure. Post 17 is installed adjacent edge 119, and members 27, 29 extend outward at an angle relative to edge 119. In the example shown, adjustable light mount 47 allows a user to rotate light module 13 relative to member 27 in the direction shown by arrow 121, thereby orienting light module 13 to correspond with edge 119 of the activity area.

Figure 14:
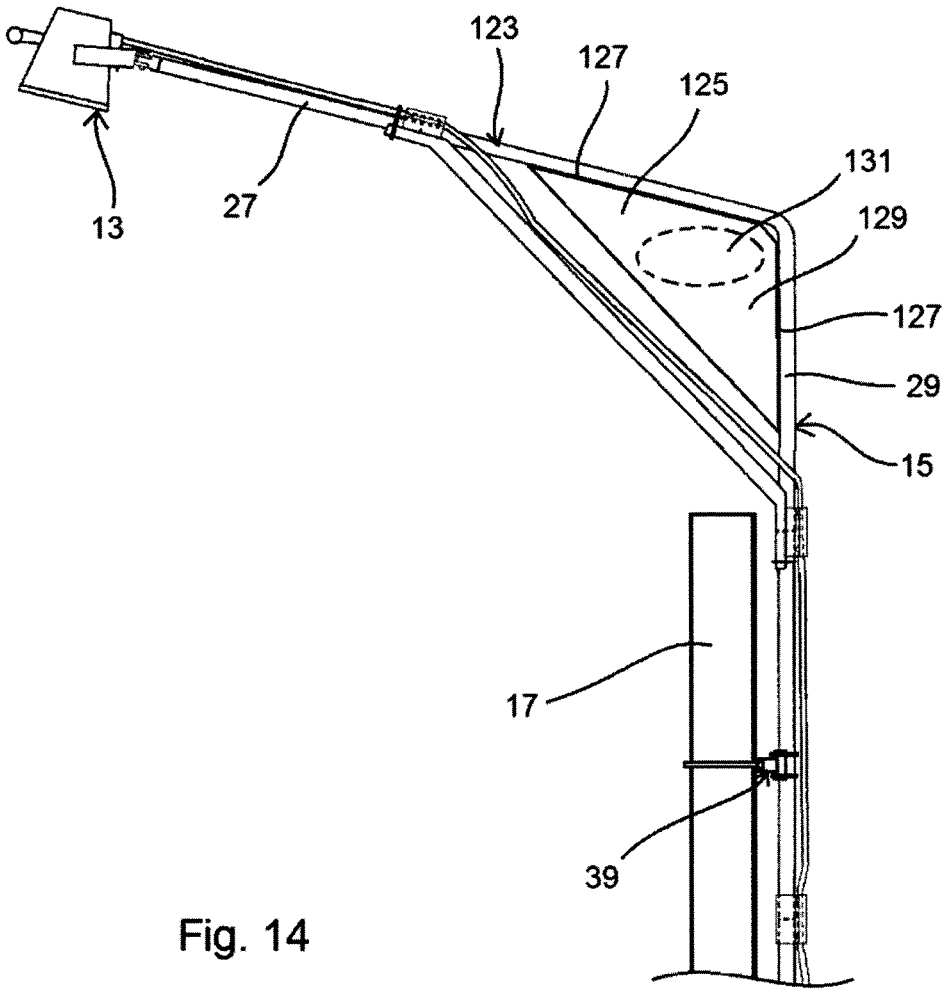
FIG. 14 is a side view of an alternative embodiment of a lighting system according to this patent application, the system shown installed on a post.

FIG. 14 illustrates another embodiment of a lighting system according to this patent application. Lighting system 123 is constructed and configured to be similar to system 11, as described above, and is shown installed on post 17. However, to provide additional strength and utility to pole 15, a gusset 125 is welded, fastened, adhered, or otherwise attached to member 29 at edges 127. Gusset 125 strengthens member 29, allowing member 29 to resist additional bending or twisting forces. In addition, gusset 125 provides surface area 129, which is visible from both sides of pole 15 and allows for placement of indicia 131, which may be, for example, used for identification, advertising, and/or ornamental purposes. Gusset 125 is shown as a single solid, planar sheet, though gusset may be of various types, including skeletonized sheets and elongate members, and may comprise one or more sheets attached on either or both sides of member 29.

It is apparent that a system and components with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although various embodiments are shown above, they are not limited to just these embodiments, but are amenable to various changes and modifications without departing from the spirit thereof.

What is claimed is:

1. A lighting system adapted to be coupled to a separate post, the system comprising:

a pole extending upward and then outward, the pole having multiple members configured to be assembled together at joints between swaged and non-swaged ends of the multiple members;

a light module coupled to the pole; and at least one tubular sleeve enclosing a joint for providing rigidity to the joint;

a single-piece bracket having a first portion adapted to couple to the post and a second portion configured to couple to the pole, the first portion having a pair of slots and the second portion having a convex pole mount configured to receive and partially surround the pole to prevent sideways translation of the pole relative to the bracket while installing the pole on the post;

wherein the first portion of the bracket couples to the post independently of the second portion of the bracket coupling to the pole;

wherein the pair of slots are elongated openings aligned perpendicular to the pole;

wherein the at least one tubular sleeve is comprised of a pair of flats extending outwardly from the sleeve; and wherein the pair of flats are configured to compress the joint.

2. The system of claim 1, further comprising:

a rotatable coupling having;

a clevis on the light module; and a tang on the pole, the rotatable coupling connecting the light module and the pole;

wherein the light module is rotatable horizontally relative to the pole through the clevis and the tang.

3. The system of claim 1, wherein at least one member has portions that form an angle, and a gusset is installed adjacent the angle for strengthening the associated member; and wherein the gusset is planar.

4. A lighting system adapted to be coupled to a separate post, the system comprising:

a pole extending upward and then outward, the pole having multiple members configured to be assembled together at joints;

a light module coupled to the pole; and a bracket having a first portion adapted to couple to the post and a second portion configured to couple to the pole, the first portion having a pair of slots and the second portion having a convex pole mount configured to receive and partially surround the pole to prevent sideways translation of the pole relative to the bracket while installing the pole on the post;

wherein the convex pole mount is an elongated curved piece held between the pole and the post, a tangent line of the curved piece being parallel to the slots of the first portion;

wherein the first portion of the bracket couples to the post independently of the second portion of the bracket coupling to the pole; and wherein the pair of slots are elongated openings aligned perpendicular to the pole.

5. The system of claim 4, further comprising:

at least one tubular sleeve enclosing a joint for providing rigidity to the joint.

6. The system of claim 4, further comprising:

a rotatable coupling having;

a clevis on the light module; and a tang on the pole, the rotatable coupling connecting the light module and the pole;

wherein the light module is rotatable horizontally relative to the pole.

7. The system of claim 4, wherein at least one member has portions that form an angle, and a planar gusset is installed adjacent the angle for strengthening the associated member.

8. A lighting system adapted to be coupled to a separate post, the system comprising:

a pole extending upward and then outward, the pole having multiple members configured to be assembled together at joints;

a light module; and a rotatable coupling having;

a clevis on the light module; and a tang on the pole, the rotatable coupling connecting the light module to the pole;

a bracket having a first portion adapted to couple to the post and a second portion configured to couple to the pole, the first portion having a pair of slots and the second portion having a convex pole mount configured to receive and partially surround the pole to prevent sideways translation of the pole relative to the bracket while installing the pole on the post;

wherein the convex pole mount is an elongated curved piece held between the pole and the post, a tangent line of the curved piece being parallel to the slots of the first portion;

wherein the first portion of the bracket couples to the post independently of the second portion of the bracket coupling to the pole;

wherein the pair of slots are elongated openings aligned perpendicular to the pole; and wherein the light module is rotatable horizontally relative to the pole through the clevis and the tang.

9. The system of claim 8, further comprising:

at least one tubular sleeve enclosing a joint for providing rigidity to the joint.

10. The system of claim 8, wherein at least one member has portions that form an angle, and a planar gusset is installed adjacent the angle for strengthening the associated member.

11. A lighting system adapted to be coupled to a separate post, the system comprising:

a pole extending upward and then outward, the pole having multiple members configured to be assembled together at joints;

a light module coupled to the pole; and a planar gusset installed adjacent the angle for strengthening the associated member;

a single-piece bracket having a first portion adapted to couple to the post and a second portion configured to couple to the pole, the first portion having a pair of slots and the second portion having a convex pole mount configured to receive and partially surround the pole to prevent sideways translation of the pole relative to the bracket while installing the pole on the post;

wherein the first portion of the bracket couples to the post independently of the second portion of the bracket coupling to the pole;

wherein the pair of slots are elongated openings aligned perpendicular to the pole; and wherein the planar gusset is non-removable from the associated member.

12. The system of claim 11, further comprising:

a rotatable coupling having;

a clevis on the light module; and a tang on the pole, the rotatable coupling connecting the light module to the pole;

wherein the light module is rotatable relative to the pole.

13. The system of claim 11, further comprising:

at least one tubular sleeve enclosing a joint for providing rigidity to the joint.

14. A lighting system adapted to be coupled to a separate post, the system comprising:

a pole extending upward and then outward, the pole having multiple members configured to be assembled together at joints, an angled member having portions that form an angle;

a light module coupled to the pole;

an elongate strut having a convex flange at each end, the strut extending between joints formed by the angled member and members assembled to the angled member, each flange being attached to the pole by a clamp and each flange at least partially enclosing the associated joint for providing rigidity to the joint; and a single-piece bracket having a first portion adapted to couple to the post and a second portion configured to couple to the pole, the first portion having a pair of slots and the second portion having a convex pole mount configured to receive and partially surround the pole to prevent sideways translation of the pole relative to the bracket while installing the pole on the post;

wherein the first portion of the bracket couples to the post independently of the second portion of the bracket coupling to the pole;

wherein the pair of slots are elongated openings aligned perpendicular to the pole; and wherein each flange is in contact with two multiple members.

15. The system of claim 14, further comprising:

a rotatable coupling having;

a clevis on the light module; and a tang on the pole, the rotatable coupling connecting the light module and the pole;

wherein the light module is rotatable horizontally relative to the pole.

16. The system of claim 14, further comprising:

at least one tubular sleeve enclosing a joint for providing rigidity to the joint.

* * * * *